US005989137A

United States Patent [19]

Krueger

[11] Patent Number: 5,989,137

[45] Date of Patent: Nov. 23, 1999

[54] BALL MOUNTED TRAINING DEVICE

[76] Inventor: Scott A. Krueger, 3525 E. Van Norman Ave., Cudahy, Wis. 53110

[21] Appl. No.: 09/028,612

[22] Filed: Feb. 24, 1998

[51] Int. Cl.[6] ..... A63B 69/40; A63B 71/02

[52] U.S. Cl. ..... 473/423; 473/429; 473/451

[58] Field of Search ..... 473/422, 423, 473/429, 451, FOR 103, FOR 108

[56] References Cited

U.S. PATENT DOCUMENTS

| | | | |
|---|---|---|---|
| 2,976,040 | 3/1961 | Bales | 473/429 |
| 3,731,926 | 5/1973 | Vincent | 473/429 X |
| 4,307,888 | 12/1981 | Ohle | 473/429 |
| 5,303,914 | 4/1994 | Cooksey | 473/429 |
| 5,340,101 | 8/1994 | Lawson et al. | 473/426 |
| 5,435,545 | 7/1995 | Marotta | 473/451 X |
| 5,458,326 | 10/1995 | Marcyes | 473/426 |
| 5,553,848 | 9/1996 | Amron | 473/429 X |
| 5,618,039 | 4/1997 | Tsai et al. | 473/423 |
| 5,662,537 | 9/1997 | Zuber | 473/426 |

*Primary Examiner*—John A. Ricci
*Attorney, Agent, or Firm*—Andrus, Sceales, Starke & Sawall

[57] ABSTRACT

A ball striking device is adapted to be mounted on a vertical mounting surface having retention structure thereon. The device includes a clip removably attached to and suspended from the retention structure of the vertical mounting surface. A mounting member having a substantially horizontally extending support arm provided with a free end and a substantially vertically extending pivot leg is engageable with the clip in order that the mounting member is swingably supported relative to the clip and the vertical mounting surface. A ball is attached directly to the free end of the support arm and is adapted to be struck by a moving object. An elastic arrangement extends between the pivot leg and the vertical mounting surface for establishing the position of the ball before being stuck and controlling the return of the ball after being struck.

21 Claims, 2 Drawing Sheets

10
40
54
18
16
14
12
66
20
68
28
30
60
64

54
50
48
52
18
16
56
42
46
3
40a
32
58
10
14
40
22
44
4
4
24
34
38
28
60
20
64
3

42
32
44
14
34
36
38
24
26
28
30
60
66
64
20
62

26
38
44
60
24

BALL MOUNTED TRAINING DEVICE

FIELD OF THE INVENTION

This invention relates broadly to athletic training equipment used in perfecting athletic skills in which a ball is struck and, more particularly, pertains to a portable, simplified batting training device having a swingable, ball equipped mounting member which is easily installed and dismantled, and positively adapted to a vertical mounting surface, preferably in the form of a chain link fence.

BACKGROUND AND SUMMARY OF THE INVENTION

Various existing batting practice devices are known which permit a baseball player to practice his or her hitting without the need for a pitcher or pitching machine and a ball chaser.

The patent to Marcyes, U.S. Pat. No. 5,458,326 issued Oct. 17, 1995 discloses a batting practice apparatus that employs a cyclone fence as an upright, rigid support. A rigid, horizontal arm is detachably secured at one end to the top of the fence. At the other end of the horizontal arm is detachably secured the upper end of a vertically extending shock cord. At the other end of the shock cord is attached an anchoring spike. Intermediate the ends of the shock cord is a ball. The shock cord passes freely through the ball along its vertical axis. A tether passes horizontally through the ball at a location confronting the fence. Opposite ends of the tether are removably secured to the fence to form a triangle for adjusting the horizontal location of the ball.

In a patent to Zuber, U.S. Pat. No. 5,662,537, issued Sep. 2, 1997, there is set forth a tether batting practice device which includes a ball, an elongated support arm made from plastic pipe and various plastic fittings, and a strand of flexible material tethering the ball from the support arm. A plastic adaptor fitting is provided on the first end portion of the support arm for removably attaching the support arm to a separate mounting member. A plastic T-fitting is provided on the second end portion of the support arm for providing a rotatable structure on the support arm. A plastic plug fitting is secured to the plastic T-fitting, and the strand is secured to the plastic plug fitting. Various mounting members are disclosed to mount the apparatus on various existing support structures, including a post, a chain link fence, and an umbrella stand base.

In U.S. Pat. No. 5,340,101, issued Aug. 23, 1994 to Lawson et al., a training apparatus for batters includes an arm assembly for rested engagement with a fence or other support. A brace depends from the arm and engages the fence. An elastic tie down urges the brace into fence engagement to lock the arm assembly in place. A tether carried by the arm outer end passes through a baseball which is adjustably supported and placed along the tether by a cable clamp. the lower end of the tether is anchored in a yieldable manner to a fence component. An elastic member serves to inhibit tether movement. The tether is clamped at its upper end of the arm with an end segment clamped in place to a plate on the arm.

In U.S. Pat. No. 4,307,888 issued Dec. 29, 1981 to Ohle, a soccer kicking trainer comprises an elongated mounting arm having a loop at one end preceding a soccer ball attached to the loop by elastic bands and having at the other end an extended elbow extending vertically downward for inserting loosely and pivotably in holding eyes which are attached to a vertical mounting post. The mounting arm is equipped with a biasing element for returning the ball to its original position after it has been kicked.

The existing devices as set forth in the above-noted patents have several drawbacks which need to be overcome. They mount on chain link fences or other vertical supports in a manner which causes deformity or damage to the fence or support. Eventually, they may break away from their support and cause a safety hazard to the batter. They sometimes consist of an unduly number of parts which causes them to be overly complicated, unreasonably expensive or difficult to adjust. Parts of these devices are of a size which makes these devices difficult to transport. In addition, such devices may require special tools or fasteners for assembling and disassembling.

It remains desirable to provide a ball mounted training device which overcomes the drawbacks of the prior art without being complex in structure and function. It further remains desirable to provide a batting training device which is swingably mounted relative to a fence or other vertical support in an extremely stable manner. It is also desirable to provide a baseball training kit which is compactly designed to be carried easily in a gym or equipment bag.

SUMMARY OF THE PRESENT INVENTION

It is a principal object of the present invention to provide a batting practice device which is slidably mounted and suspended on a chain link fence without special tools or fasteners.

It is also an object of the present invention to provide a ball striking device which is easily adjustable along the height of a vertical mounting surface.

It is an other object of the present invention to provide a batting training device which will enable a baseball player to practice spray and rapid hitting.

It is a further object of the present invention to provide an improved batting training device employing a clip for enabling a stable and secured connection between a swingable, ball carrying mounting member and a chain link fence.

Yet another object of the present invention is to provide a compact batting practice kit comprised of a stabilizing clip, a ball carrying mounting member, and an elastic band arrangement, all of which are transportable in a gym or equipment bag.

Still a further object of the present invention is to provide a batting practice device utilizing an elastic band arrangement to help establish a starting position in which a ball is struck, and to control the return of the ball after being hit.

Moreover, another object of the present invention is to provide a method of installing a ball striking device on a vertical mounting surface.

Another object of the present invention is to provide a batting practice device capable of use by baseball players of all skill levels.

In one aspect of the invention, a ball striking device is adapted to be mounted on a vertical mounting device having retention structure thereon. The device includes a clip removably attached and suspended from the retention structure of the vertical mounting surface. A mounting member having a substantially horizontally extending support arm provided with a free end and a substantially vertically extending pivot leg is engageable with the clip in order that the mounting member is swingably supported relative to the clip and the vertical mounting surface. A ball is attached directly to the free end of the support arm and adapted to be struck by a moving object. An elastic arrangement extends between the pivot leg and the vertical mounting surface for enabling the position of the ball before being struck and controlling the return of the ball after being struck. The clip is suspended from and slidably mounted upon the retention structure of the vertical mounting surface. In one embodiment, the clip has a rear structure and a forward structure connected thereto in generally parallel relationship. The rear structure includes a first pair of parallel legs which merge together at upper ends in a first downwardly and forwardly projecting loop. The forward structure includes a second pair of parallel legs which merge together at lower ends in a second downwardly and forwardly projecting loop. In an alternative embodiment, the clip has a forward structure in the form of a solid plate terminating in a forwardly extending ledge disposed generally perpendicular to the plate. In both embodiments, the free end of the mounting member extends generally upwardly from the support arm, and the support arm is provided with a protective coating. The elastic arrangement is comprised of at least one bungee cord which extends downwardly and outwardly between the pivot leg and the vertical mounting surface. In the preferred embodiment, the pivot leg is engageable against the retention structure of the vertical mounting surface, and in the alternative embodiment, the pivot leg is supportably engageable against the solid plate.

In another aspect of the invention, a batting practice device is adapted to be mounted relative to a vertically extending chain link fence. The device includes a stabilizing clip which is slidably mounted on and suspended from the chain link fence in a manner which will preserve the integrity of the chain link fence. A generally, Z-shaped, rigid mounting member has a substantially horizontally support arm provided with a free end and is integrally joined by an elbow suspended on the stabilizing clip to a substantially vertically and downwardly extending pivot leg. The mounting member is slidably mounted with respect to the stabilizing clip at a position forwardly of the chain link fence so that the mounting member is swingably supported about a vertical axis relative to the fence. A ball is attached directly to the free end of the support arm and is adapted to be struck by a bat. At least one elastic band is connected between the pivot leg and the chain link fence for establishing a starting position of the ball before being struck by the bat and controlling return of the ball to the starting position after being hit by the bat. The elastic band prevents the dislodging of the mounting member from the stabilizing clip as a result of the striking of the ball. The stabilizing clip and the mounting member are preferably constructed of a stainless steel material.

In yet another aspect of the invention, a batting practice kit is adapted to be mounted relative to a vertically extending chain link fence. The kit includes a rigid stabilizing clip having a rear structure and a forward structure connected thereto at respective upper ends and spaced therefrom to define an open passageway therebetween for receiving the chain link fence. The rear structure has a bottom free end which extends vertically upwardly relative to the chain link fence and terminates in an upper portion including a downwardly and forwardly projecting loop. The forward structure extends substantially vertically and downwardly from the upper portion of the rear structure and terminates in a bottom end having an opening therein. The stabilizing clip is suspended from the chain link fence and slidably mounted such that the rear structure is disposed on one side of the links of the chain link fence and the forward structure is positioned on the other side of the links of the chain link fence. A generally Z-shaped, rigid mounting member has a substantially horizontally extending support arm provided with an upwardly extending free end and is integrally joined by an elbow engageable with the loop of the stabilizing clip to a substantially vertically and downwardly extending pivot leg. The mounting member is slidably mounted in the passageway of the stabilizing clip at a position forwardly of the chain link fence so that the mounting member is swingably supported about a vertical axis relative to the chain link fence. A bottom end of the pivot leg has an anchoring tap projecting downwardly and forwardly therefrom. A ball is fixedly attached directly to the free end of the support arm and is adapted to be struck by a bat. At least one elastic band is connected between the anchoring tab of the pivot leg and the chain link fence for establishing a starting position of the ball before being struck by the bat and controlling the return of the ball after being struck by the bat. The elastic band exerts a force which will prevent the dislodging of the mounting member from the stabilizing clip as a result of striking of the ball. The pivot leg is passed through the loop of the rear structure and the opening in the forward structure of the stabilizing clip. The forward structure of the stabilizing clip has a length which is shorter than a length of the rear structure of the stabilizing clip. In one embodiment, the rear structure includes a first pair of parallel legs and the forward structure includes a second pair of parallel legs. In the alternative embodiment, the rear structure includes a pair of parallel legs and the forward structure includes a solid plate. The support arm is swingable through approximately 180° and is stopped by the fence after being hit by the bat. In the alternative arrangement, there are two elastic bands, one being provided on one side of the stabilizing clip and the other being provided on the other side of the stabilizing clip.

Still another aspect of the invention relates to a method of installing a batting training device relative to a vertically extending mounting surface having retention structure. The method includes the steps of removably attaching a clip to the retention structure of the vertical mounting surface; providing a mounting member having a substantially horizontally extending support arm provided with a free end and a substantially vertically extending pivot leg engageable with the clip in order that the mounting member is swingably supported about a vertical axis relative to the clip and the vertical mounting surface; attaching a ball directly on the free end of the support arm so as to be struck by a moving object; and connecting an elastic arrangement between the pivot leg and the vertical mounting surface for establishing the position of the ball before being struck and controlling return of the ball after being struck.

The invention further contemplates a ball striking device which is adapted to be mounted upon a vertical mounting surface having retention structure for swingably supporting a ball equipped mounting member thereon. The striking device is improved by a stabilizing clip having a rear structure and a forward structure spaced therefrom to define an open passageway therebetween for receiving the retention structure of the vertical mounting surface. The rear structure has a bottom free end which extends vertically upwardly relative to the vertically mounting surface, and terminates in an upper portion including a downwardly and forwardly projecting loop. The forward structure extends substantially vertically and downwardly from the upper portion of the rear structure, and terminates at a bottom end having an opening therein. The stabilizing clip is suspended from the retention structure of the vertical mounting surface and is slidably mounted such that the rear structure is disposed on one side of the retention structure of the vertical mounting surface and the forward structure is positioned on the other side of the retention structure of the vertical mounting surface. At least one elastic band is connected between the mounting member and the vertical mounting surface for exerting downward and lateral forces preventing dislodging of the mounting member from the stabilizing clip as a result of the striking of the ball.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
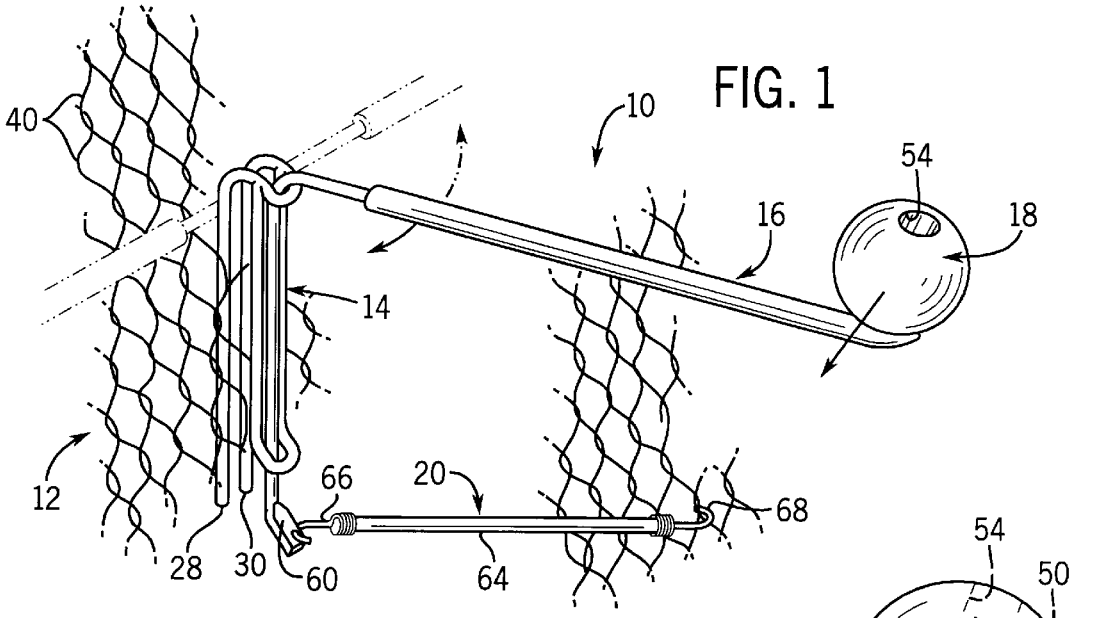
FIG. 1 is a perspective view of a batting training device embodying the present invention and installed upon a chain link fence.
Figure 2:
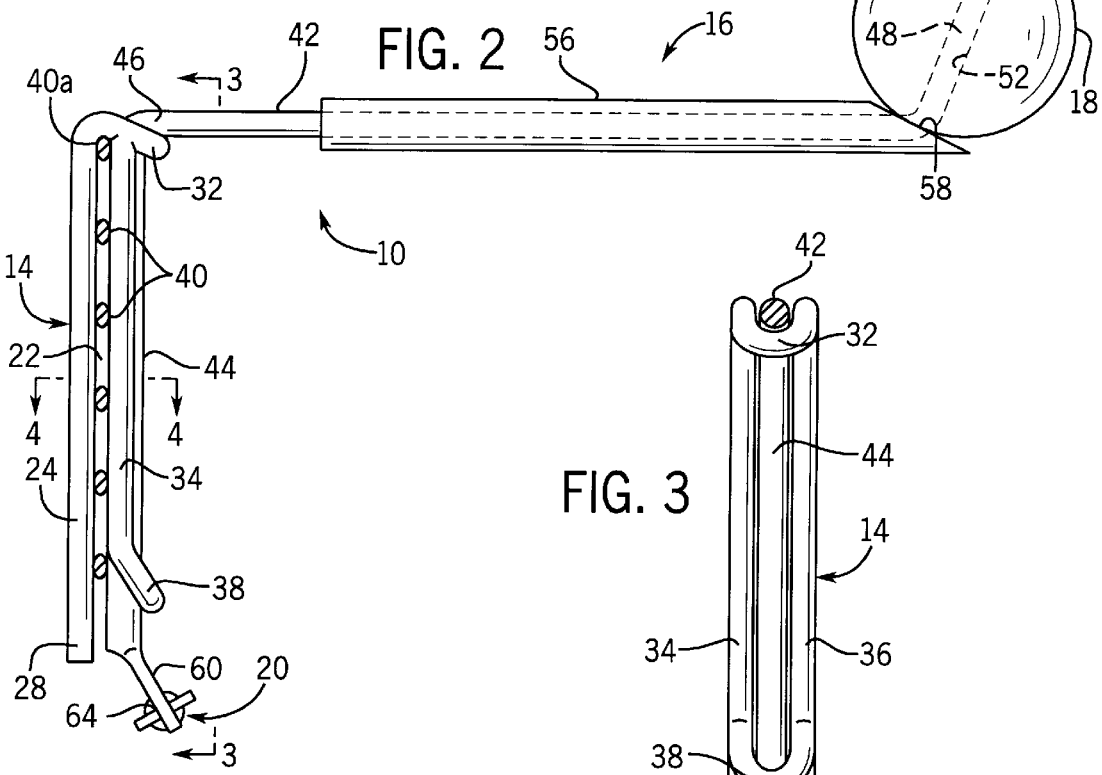
FIG. 2 is an elevational view of the batting training device shown in FIG. 1.
Figure 3:
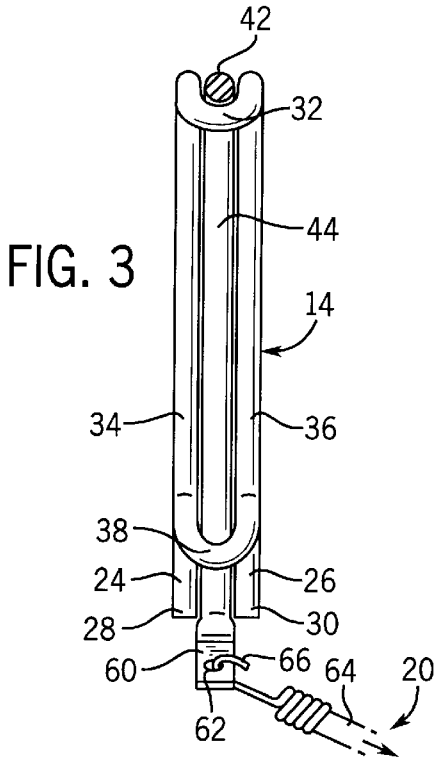
FIG. 3 is a fragmentary, cross-sectional view taken along lines 3—3 of FIG. 2.
Figure 4:
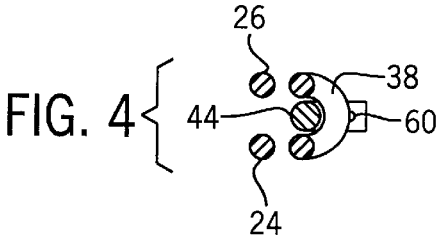
FIG. 4 is a cross-sectional view taken along lines 4—4 of FIG. 2.

Referring first to FIGS. 1–4, there is shown a ball striking device generally identified by the reference numeral 10. In the embodiments shown, the invention is depicted as a batting training and practice device adapted to be movably mounted on a cyclone or chain link fence 12 which is permanently installed at a baseball or softball field. However, it should be fully understood that the invention has broader utility as a training and practice device 10 in which balls may be struck by a moving object such as a tennis racket, a golf club or even one's foot when used with a soccer ball. In these other applications, the training and practice device 10 is adapted to be mounted to some type of vertical mounting surface such as a wall, a post or a stand having retention structure thereon. As will be understood hereafter, the batting and training device 10 is constructed of materials which permit use of the device for both indoor and outdoor applications.

Batting training and practice device 10 generally includes a stabilizing clip 14, a mounting member 16, a ball 18 captively held on the mounting member 16, and an elastic arrangement 20.

Stabilizing clip 14 is a rigid, wire-like member having a rear structure and a front structure connected thereto at respective upper ends, and spaced therefrom in generally parallel relationship to define an open passageway 22 for receiving the chain link fence 12 or other retention structure of a vertical mounting surface. The rear structure includes a first pair of parallel legs 24, 26 having bottom free ends 28, 30 which extend vertically upwardly relative to the fence 12 and terminate in an upper portion including a first downwardly and forwardly projecting loop 32. The forward structure of the clip 14 has a length which is generally shorter than the length of the rear structure and includes a second pair of parallel legs 34, 36 which are typically welded to the bottom of the first loop 32. The legs 34, 36 extend vertically and downwardly from the upper portion of the rear structure, and merge together in a second downwardly and forwardly projecting loop 38. This construction enables the clip 14 to be slidably mounted over and suspended from the uppermost link 40*a* of an aligned group of fence links 40 such that the rear structure is disposed on the back side of the fence 12 and the forward structure is positioned on the front side of the fence 12.

Mounting member 16 is a generally Z-shaped, rigid component of cylindrical cross section having a substantially horizontal support arm 42 integrally joined at a substantially right angle to a substantially vertically and downwardly extending pivot leg 44 by an elbow portion 46. The support arm 42 is provided with an upwardly and outwardly free end 48 which is threaded to receive a nut 50 thereon. Ball 18 is typically fabricated of a durable urethane or similar material which will withstand the effects of continuous hitting by a moving object such as a bat. The ball 18 is formed with an internal channel 52 having a diameter which will permit reception of the free end 48 of the support arm 42. The channel 52 extends from a lower point on the ball periphery and leads into an enlarged, inwardly extending opening 54 which is dimensioned to accommodate the nut 50 and one's fingers to tighten the nut 50 once the ball 18 has been placed on the free end 48. The support arm 42 is preferably provided with a vinyl coating or jacket 56 which surrounds a substantial portion of the arm length between the elbow portion 46 and the free end 48, and protects the bat from damage when hitting the ball 18. Jacket 56 has a truncated outer edge 58 which fits snugly up against the lower periphery of the fixed ball 18.

The pivot leg 44 has a bottom end which projects downwardly and forwardly to define an anchoring tab 60 having an aperture 62 for receiving one end of the elastic arrangement 20. Pivot leg 44 is passed through the first loop 32 of the clip rear structure and the second loop 38 of the clip forward structure. As seen best in FIG. 2, the elbow portion 46 and the uppermost end of the leg 44 are engageable with the internal surface of the first loop 32, the rear side of the leg 44 lies against the front side of the fence 12, and the bottom end of the leg 44 protrudes beyond the second loop 38. In this position, the mounting member 16 is swingably mounted about a vertical axis relative to the fence 12 and the clip 14. As shown in phantom lines in FIG. 1, mounting member 16 is able to swing through substantially 180° of movement with the support arm 42 being stopped by the fence 12 after the ball 18 is hit by either a left handed or right handed batter.

The elastic arrangement 20 is comprised of at least one elastic band 64 preferably in the form of a conventional bungee cord having opposed end hooks 66, 68. End hook 66 is engageable with the walls of the aperture 62 formed in the anchoring tab 60 on the bottom end of pivot leg 44. To ensure engagement of the bungee cord 64 with the pivot leg 44, it may be desirable to crimp the end hook 66 or otherwise employ a spring-biased retaining clip (not shown) in lieu of the end hook 66. The other end hook 68 is removably attached to the fence 12 such that the bungee cord 64 extends downwardly and laterally relative to the clip 14. In the position shown in FIG. 1, the bungee cord 64 is connected such that the support arm 42 with the ball 18 captively held thereon, projects generally perpendicularly to the plane of the fence 12 in a central starting position. However, if it is desirable to change the angular position of the support arm 42 so that the ball 18 is positioned closer or farther from the batter, it is a simple matter to place the end hook 68 accordingly on the fence 12 to one side or another of the clip 14. In addition, to establishing a starting position of the ball 18 before it is hit, the elastic arrangement 20 also exerts downward and lateral forces which prevent the upward dislodging of the pivot leg 44 relative to the stabilizing clip 14 often caused by hitting of the ball 18.

The batting practice and training device 10 is conveniently and economically sold as a kit which is comprised of the dismantled stabilizing clip 14, the mounting member 16 with the ball 18 fixed in place and at least one bungee cord 64 which may be variously attached to the bottom end of pivot leg 44. Each of the kit components are sized to be carried together in a gym or equipment bag. To install the device 10, one simply slides the stabilizing clip 14 on the fence 12, such that the underside of the first loop 32 is suspended on the uppermost link 40*a* of the aligned vertical group of links 40. When the clip 14 is in place upon the fence 12, the first loop 32 should generally be at a height which corresponds to a proper vertical hitting zone of the batter. Then, the pivot leg 44 of mounting member 16 is passed through the first and second loops 32, 38 of the clip 14, and the free hook end 68 of bungee cord 64 is removably attached to the fence 12 in a manner so as to swingably mount the mounting member 16 to the fence 12 and establish an initial or starting position of the ball 18. Alternatively, the mounting member 16 can be mounted on the stabilizing clip 14 before the clip is slidably mounted on the fence. With the bungee cord 64 positioned as shown in FIG. 1, a right handed batter strikes the ball 18 causing the support arm 42 to swing away from the batter and hit the fence 12, the bungee cord 64 causing the mounting member 16 and the ball 18 to quickly snap back to the initial or starting position.

It should be fully appreciated that the batting and training device 10 may be equipped with variously sized baseballs or softballs and can be advantageously used to practice spray hitting in which various directional forces are applied to the ball 18 by the bat. The device 10 is also particularly adept at allowing rapid or continuous hitting which improves hand and eye coordination. The device 10 allows variable positioning of the ball so as to enable the batter to address his or her deficiencies at the appropriate skill level. For example, an instructor can work on different areas of any batter's mechanics, such as positioning of the feet, the proper movement of hips and knees, hand positioning and head and shoulder alignment. The device 10 is also helpful as a warm-up tool prior to the playing of a baseball or softball game.

FIGS. 5–8 show an alternative and preferred embodiment of the device 10' which is similar in structure to the device 10 except for the stabilizing clip 14' and the elastic arrangement 20'. In this version, clip 14' includes a rear structure exactly as described above. However, the forward structure is comprised of a rigid, solid support plate 70 having a rearwardly projecting upper ledge 72 adapted to be suspended on the uppermost fence link 40*a*, and an offset vertical edge 74 which is typically welded to the inside, upper portion of the rear structure legs 24, 26. Support plate 70 extends downwardly in front of the fence 12 and terminates in a forwardly projecting ledge 76 provided with a suitable opening 78 through which the bottom end of the pivot leg 44 passes. The solid support plate 70 enables a substantial portion of pivot leg 44 to bear against the front face thereof so as to further improve the stability of the device 10'.

Elastic arrangement 20' is contemplated to include two separate bungee cords 80, 82, each being connected between the anchoring tab 60 on the bottom of pivot leg 44 at a suitable location on one side of the fence 12. In the position shown in FIGS. 5 and 7, the bungee cords 80, 82 generally hold the mounting member 16 and its ball 18 in a starting position in which the support arm 42 is generally perpendicular to the plane of the fence 12. However, the position of the bungee cords 80, 82 can be varied as desired to attain the necessary effect desired by the batter. For instance, both bungee cords 80, 82 could be positioned to one side of the fence 12 when it is desired to improve not only the hitting accuracy, but the power of the batting stroke. The installation and use of the device 10' is in all other respects similar to that described above in connection with the device 10.

In the preferred embodiment, it is preferable that the clip 14 is formed from zinc-plated, carbon steel and the mounting member 16 is formed from stainless steel which are suitable for all indoor and outdoor environments. In a typical installation, the diameter of the clip rear structure is about 0.243 inches in diameter and the overall length from the bottom of the legs 24, 26 to the top of the first loop 32 is about 6.25 inches. If desired, the bottom ends of the legs 24, 26 may be chamfered or otherwise formed to create a guide surface for sliding the clip 14 into the fence 12. The first loop 32 extends downwardly and forwardly from the upper portion of the legs 24, 26 at an obtuse angle of about 135° so as to enable the proper mounting of the support arm 42 with respect thereto. The length of the support plate 70 is preferably 5.25 inches and the width of the passageway 22 is approximately 0.187 inches with respect to the mounting member 16, support arm is about 0.332 inches in diameter and about 16 inches in length with free end 48 measuring approximately 2.375 inches in length. Pivot leg 44 is about 7 inches long with its anchoring tab 60 disposed at about 150° downwardly and forwardly from the longitudinal axis thereof.

In contrast with prior art batting and training devices, the present invention excels in providing a markedly simplified and easily installed/dismantled system in which the interfacing connection of the swingable mounting member 16 to the fence 12 is significantly enhanced by the stabilizing clip 14. In predecessor systems, the forces generated during hitting caused deformation and damage to the links 40 of the fence 12. The clip 14 of the present invention preserves the integrity of the fence 12. This position of the elastic arrangement 20 further improves over the prior art by maintaining the cooperative engagement between the stabilizing clip 14 and the mounting member 16 regardless of the forces generated from the bat impacting upon the ball.

Figure 5:
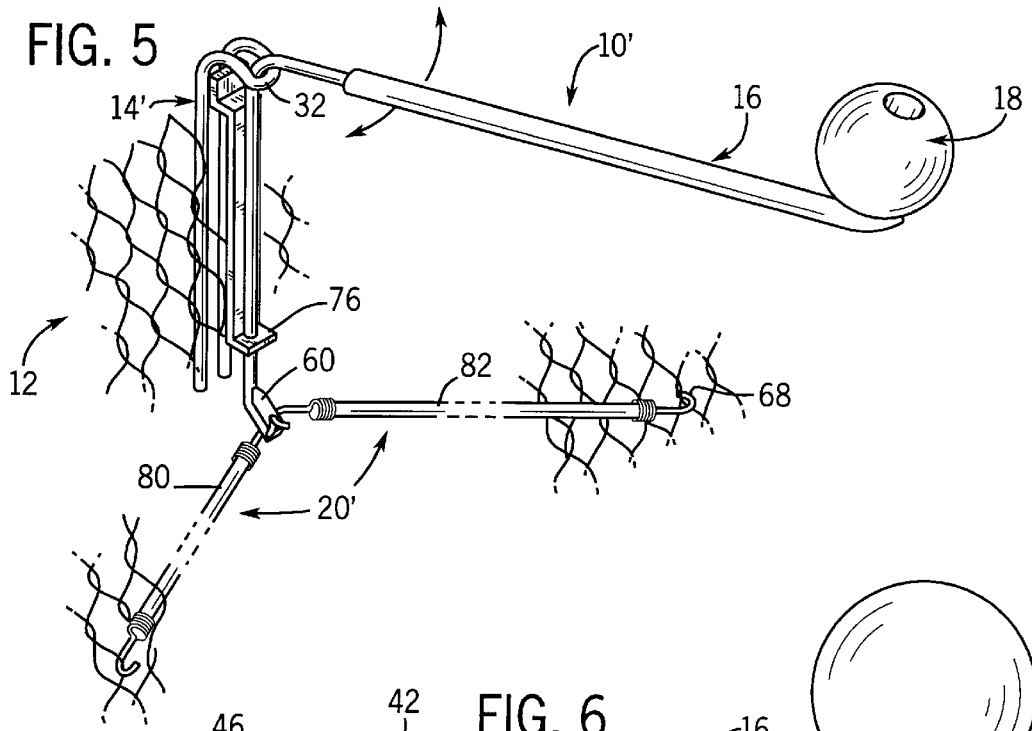
FIG. 5 is a first alternative embodiment of the batting training device embodying the present invention.
Figure 6:
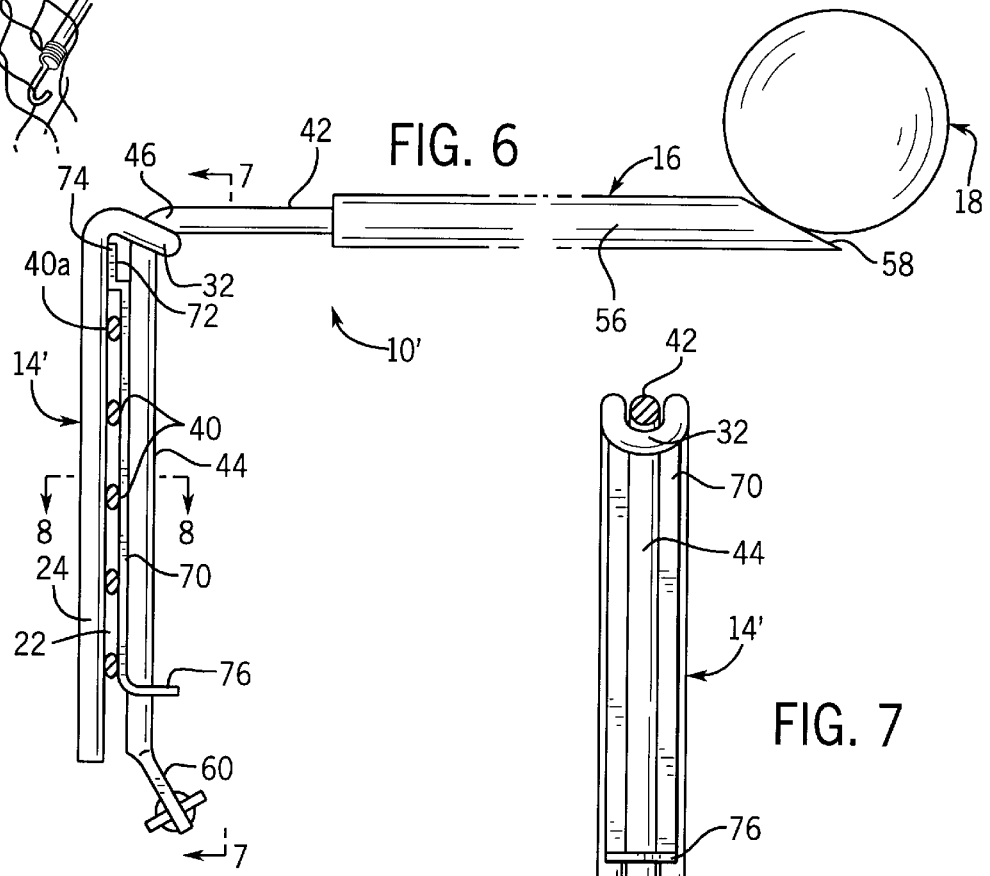
FIG. 6 is an elevational view of the batting training device shown in FIG. 5.
Figure 7:
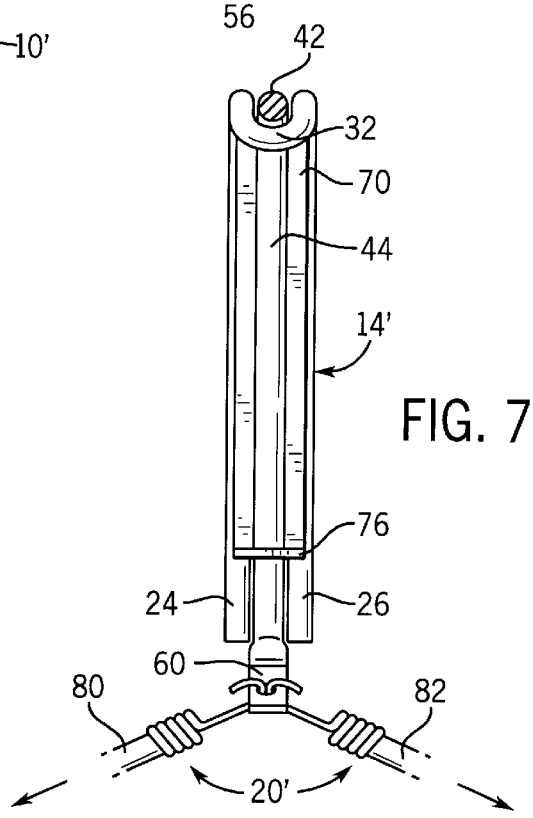
FIG. 7 is a fragmentary, cross-sectional view taken along lines 7—7 of FIG. 6.
Figure 8:
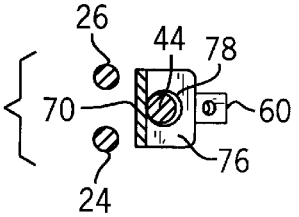
FIG. 8 is a cross-sectional view taken along lines 8—8 of FIG. 6.

While the invention has been described with reference to a preferred embodiment, those skilled in the art will appreciate that certain substitutions, alterations, and omissions may be made without departing from the spirit thereof. For example, instead of using two separate bungee cords as shown in FIGS. 5 and 7, a single bungee cord 64 may be passed through the aperture 62 in the anchoring leg 60 with opposite hooked ends 66, 68 being connected to the fence 12 on either side of the clip 14. Accordingly, the foregoing description is meant to be exemplary only, and should not be deemed limitative on the scope of the invention as set forth in the following claims.

We claim:

1. A ball striking device adapted to be mounted on a vertical mounting surface having retention structure thereon, the device comprising:

a clip removably attached to and suspended from the retention structure of the vertical mounting surface;

a mounting member having a substantially horizontal support arm, provided with a free end and a substantially vertically extending pivot leg engageable with the clip in order that the mounting member is swingably supported relative to the clip and the vertical mounting surface;

a ball attached directly to the free end of the support arm and adapted to be struck by a moving object; and an elastic arrangement extending between the pivot leg and the vertical mounting surface for establishing the position of the ball before being struck and controlling the return of the ball after being struck.

2. The device of claim 1, wherein the clip is suspended from and slidably mounted upon the retention structure of the vertical mounting surface.

3. The device of claim 1, wherein the clip has a rear structure and a forward structure connected thereto in generally parallel relationship, the rear structure including a first pair of parallel legs which merge together at upper ends in a first downwardly and forwardly projecting loop, and the forward structure including a second pair of parallel legs which merge together at lower ends in a second downwardly and forwardly projecting loop.

4. The device of claim 3, wherein a pivot leg is engageable against the retention structure of the vertical mounting surface.

5. The device of claim 1, wherein the clip has a rear structure and a forward structure connected thereto in generally parallel relationship, the rear structure including a first pair of parallel legs merging together at upper ends in a first downwardly and forwardly projecting loop, and the forward structure including a solid plate terminating in a forwardly extending ledge disposed generally perpendicularly to the plate.

6. The device of claim 5 wherein the pivot leg is supportively engageable against the solid plate.

7. The device of claim 1, wherein the free end of the mounting member extends generally upwardly from the support arm.

8. The device of claim 1, wherein the support arm is provided with a protective coating.

9. The device of claim 1, wherein the elastic arrangement is comprised of at least one bungee cord which extends downwardly and outwardly between the pivot leg and the vertical mounting surface.

10. A batting practice device adapted to be mounted relative to a vertically extending chain link fence, the device comprising:

a stabilizing clip slidably mounted on and suspended from the chain link fence in a manner which will preserve the integrity of the chain link fence;

a generally Z-shaped, rigid mounting member having a substantially horizontally extending support arm provided with a free end and integrally joined by an elbow suspended on the stabilizing clip to a substantially vertically and downwardly extending pivot leg slidably mounted with respect to the stabilizing clip at a position forwardly of the chain link fence so that the mounting member is swingably supported about a vertical axis relative to the fence;

a ball attached directly to the free end of the support arm and adapted to be struck by a bat; and at least one elastic band connected between the pivot leg and the chain link fence for establishing a starting position of the ball before being struck by the bat, and controlling return of the ball to the starting position after being hit by the bat, the elastic band preventing the dislodging of the mounting member from the stabilizing clip as a result of the striking of the ball.

11. The device of claim 10, wherein the stabilizing clip and the mounting member are constructed of steel.

12. A batting practice kit adapted to be mounted relative to a vertically extending chain link fence, the kit comprising:

a rigid stabilizing clip having a rear structure and a forward structure connected thereto at respective upper ends and spaced therefrom to define an open passageway therebetween for receiving the chain link fence, the rear structure having a bottom free end which extends vertically upwardly relative to the chain link fence and terminates in an upper portion including a downwardly and forwardly projecting loop, the forward structure extending substantially vertically and downwardly from the upper portion of the rear structure and terminating in a bottom end having an opening therein, the stabilizing clip being suspended from the chain link fence and slidably mounted such that the rear structure is disposed on one side of the links of the chain link fence, and the forward structure is positioned on the other side of the links of the chain link fence;

a generally Z-shaped, rigid mounting member having a substantially horizontally extending support arm provided with an upwardly extending free end and joined by an elbow engageable with the loop of the stabilizing clip to a substantially vertically and downwardly extending pivot leg slidably mounted in the passageway of the stabilizing clip at a position forwardly of the chain link fence so that the mounting member is swingably supported about a vertical axis relative to the chain link fence, a bottom end of the pivot leg having an anchoring tab projecting downwardly and forwardly therefrom;

a ball fixedly attached directly to the free end of the support arm and adapted to be struck by a bat; and at least one elastic band connected between the anchoring tab of the pivot leg and the chain link fence for establishing a starting position of the ball before being struck by the bat, and controlling the return of the ball after being struck by the bat, the elastic band exerting a force which will prevent the dislodging of the mounting member from the stabilizing clip as a result of striking of the ball.

13. The kit of claim 12, wherein the pivot leg is passed through the loop of the rear structure and the opening in the forward structure of the stabilizing clip.

14. The kit of claim 12, wherein the forward structure of the stabilizing clip has a length which is shorter than a length of the rear structure of the stabilizing clip.

15. The kit of claim 12, wherein the rear structure includes a first pair of parallel legs and the forward structure includes a second pair of parallel legs.

16. The kit of claim 12, wherein the rear structure includes a pair of parallel legs and the forward structure includes a solid plate.

17. The kit of claim 12, wherein the support arm is swingable through approximately 180° and is stopped by the fence after being hit by the bat.

18. The device of claim 12, wherein there are two elastic bands, one being provided on one side of the clip and the other being provided on the other side of the clip.

19. A method of installing a batting training device relative to a vertically extending mounting surface having retention structure, the method comprising the steps of:

removably attaching a clip to the retention structure of the vertical mounting surface;

providing a mounting member having a substantially horizontally extending support arm provided with a free end and a substantially vertically extending pivot leg engageable with the clip in order that the mounting member is swingably supported about a vertical axis relative to the clip and the vertical mounting surface;

attaching a ball directly on the free end of the support arm so as to be struck by a moving object; and connecting an elastic arrangement between the pivot leg and the vertical mounting surface for establishing the position of the ball before being struck and controlling the return of the ball after being struck.

20. In a ball striking device adapted to be mounted on a vertical mounting surface having retention structure for swingably supporting a ball equipped mounting member thereon, the improvement comprising:

a stabilizing clip having a rear structure and a forward structure spaced therefrom to define an open passageway therebetween for receiving the retention structure of the vertical mounting surface, the rear structure having a bottom free end which extends vertically upwardly relative to the vertical mounting surface and terminates in an upper portion including a downwardly and forwardly projecting loop, the forward structure extending substantially vertically and downwardly from the upper portion of the rear structure terminating in a bottom end having an opening therein, the stabilizing clip being suspended from the retention structure of the vertical mounting surface and slidably mounted such that the rear structure is disposed on one side of the retention structure of the vertical mounting surface and the forward structure is positioned on the other side of the retention structure of the vertical mounting surface, the stabilizing clip holding the mounting member as the stabilizing clip is suspended from the vertical mounting surface; and at least one elastic band connected between the mounting member and the vertical mounting surface for exerting downward and lateral forces preventing the dislodging of the mounting member from the stabilizing clip as a result of striking of the ball.

21. The improvement of claim 20, wherein the vertical mounting surface is a chain link fence.

* * * * *